US006093120A

United States Patent [19]

Luke, Jr.

[11] Patent Number: 6,093,120

[45] Date of Patent: Jul. 25, 2000

[54] BASEBALL PITCHING AND THROWING TRAINING APPARATUS

[76] Inventor: John Luke, Jr., 96 Baum Bay Dr., Kill Devils Hills, N.C. 27948

[21] Appl. No.: 09/157,798

[22] Filed: Sep. 21, 1998

[51] Int. Cl.[7] ..... A63B 69/00

[52] U.S. Cl. ..... 473/454; 473/435

[58] Field of Search ..... 248/146, 150, 248/161, 167, 170, 201; 473/415–505; 273/317.6, 348, 354

[56] References Cited

U.S. PATENT DOCUMENTS

| | | | |
|---|---|---|---|
| 2,745,618 | 5/1956 | Verner | 248/170 |
| 3,370,822 | 2/1968 | Miller | 248/201 |
| 3,415,519 | 12/1968 | Hand | 248/170 |
| 4,497,485 | 2/1985 | Macosko | 473/435 |
| 4,753,408 | 6/1988 | Wailes | 248/161 |
| 4,863,166 | 9/1989 | Becera et al. | 473/454 |

*Primary Examiner*—Jeanette Chapman
*Assistant Examiner*—Mitra Aryanpour
*Attorney, Agent, or Firm*—Coats & Bennett, P.L.L.C.

[57] ABSTRACT

A baseball pitching and training apparatus includes a pair of laterally spaced upright support members. Movably mounted between the support members is a target frame or strike zone. The target frame or strike zone can be adjusted vertically up and down within the support members. To secure the pitching and throwing training apparatus in an upright position for practice, there is provided a pair of fold-out legs that are each movable between a stowed position within the basic frame structure of the training apparatus and an operative position where the legs engage an underlying support area, such as a ground surface.

13 Claims, 4 Drawing Sheets

BASEBALL PITCHING AND THROWING TRAINING APPARATUS

FIELD OF THE INVENTION

The present invention relates to athletic training devices and more particularly to a baseball pitching and throwing device that is adapted to simulate a strike zone or a target area.

BACKGROUND OF THE INVENTION

One of the key attributes of a baseball player is the player's ability to pitch and throw consistently and accurately. This is a skill that is most often developed over time and through long hours of practice. It starts when a youngster begins to play baseball and the pitching and throwing skills that are developed are often done so in the backyard where two people simply throw to each other. These pitching and throwing skills are of course refined and improved through organized play. However, when it comes to pitching and throwing, there is little substitute for practice. As pointed out above, one of the most common forms of practicing is carried out by two players essentially playing catch, that is one player throwing to the other and the other returning the throw. This, if practiced over time, can and will enhance a player's pitching skills as well as his or her basic throwing skills.

This form of practice does have a drawback. It requires two people and, or course, this means that a youngster who happens to desire to improve his pitching and throwing skills may not always have a playmate at hand in order to hone these skills.

In the prior art, there are known practice devices that have been designed to enable one person to practice his or her pitching or throwing skills with a baseball. For example, one common practice aid in this area is referred to as a rebound net. Essentially, the player throws the baseball against a rebound net and once the baseball strikes the rebound net, the baseball is rebounded back from the net. These devices have a number of shortcomings. First, they do not have a well-defined target area that allows the player to know for sure that he or she is hitting a specified target area. Next, the target area is not adjustable and therefore it is difficult to simulate a varying strike zone for a pitcher. Next, the rebound net is not a very effective way at managing pitched or thrown baseballs. This is because it is difficult to predict the area that the baseball will be rebounded to. Consequently it becomes a very time consuming and sometimes frustrating chore for the individual practicing to retrieve the baseballs and because of this many young baseball players are not encouraged to practice with such device.

Besides rebound devices, it has been known to provide other types of practice aids for those wishing to improve their baseball pitching and throwing skills. For example, see the disclosures of U.S. Pat. Nos. 4,473,227; 4,826,164; 5,083,774; 5,511,775; and 4,210,326. Still these baseball pitching and throwing practice aids have the same shortcomings and drawbacks discussed above. In particular, they do not have an adjustable strike zone or target area and besides they are often large, cumbersome and difficult to handle and move from one location to another.

Therefore, there has been and continues to be a need for baseball pitching and throwing practice aid that includes an adjustable strike zone or target area and which is light weight and easy to handle.

SUMMARY OF THE INVENTION

The present invention presents a baseball pitching and throwing training device that is designed to overcome the disadvantages or the shortcomings of prior art devices and which is particularly designed to include an adjustable strike zone or target area, and which is designed to be compact, easily storable and of a design that would enable a youngster to easily handle and move the device.

In one embodiment of the baseball pitching and throwing device of the present invention, the same includes a pair of spaced apart elongated posts that includes a movable strike zone or target area disposed there between. The strike zone or target area can be moved up and down within the upright support posts or the associated frame structure. In addition, in one embodiment of the present invention, the baseball pitching and throwing device of the present invention is provided with a fold-out leg structure for supporting the training aid in an upright practice position. When not in use, the fold-out legs can be rotated or moved to a stowed position and in the process, the overall size of the baseball training aid is reduced such that the same can be easily stored or moved from one location to another location.

It is therefore an object of the present invention to provide a baseball training aid that assists individuals, particularly youngsters beginning to play baseball, in improving their pitching and throwing skills.

Another object of the present invention resides in the provision of a baseball pitching and throwing training device that includes a movable strike zone such that a person using the device can practice pitching at strike zones spaced at various heights.

Still a further object of the present invention resides in the provision of a baseball pitching and throwing training apparatus that can be folded to a stowed position for convenient storage or which can be conveniently moved or transported from one location to another location.

Other objects and advantages of the present invention will become apparent and obvious from a study of the following description and the accompanying drawings, which are merely illustrative of such invention.

DETAILED DESCRIPTION OF THE INVENTION

Figure 1:
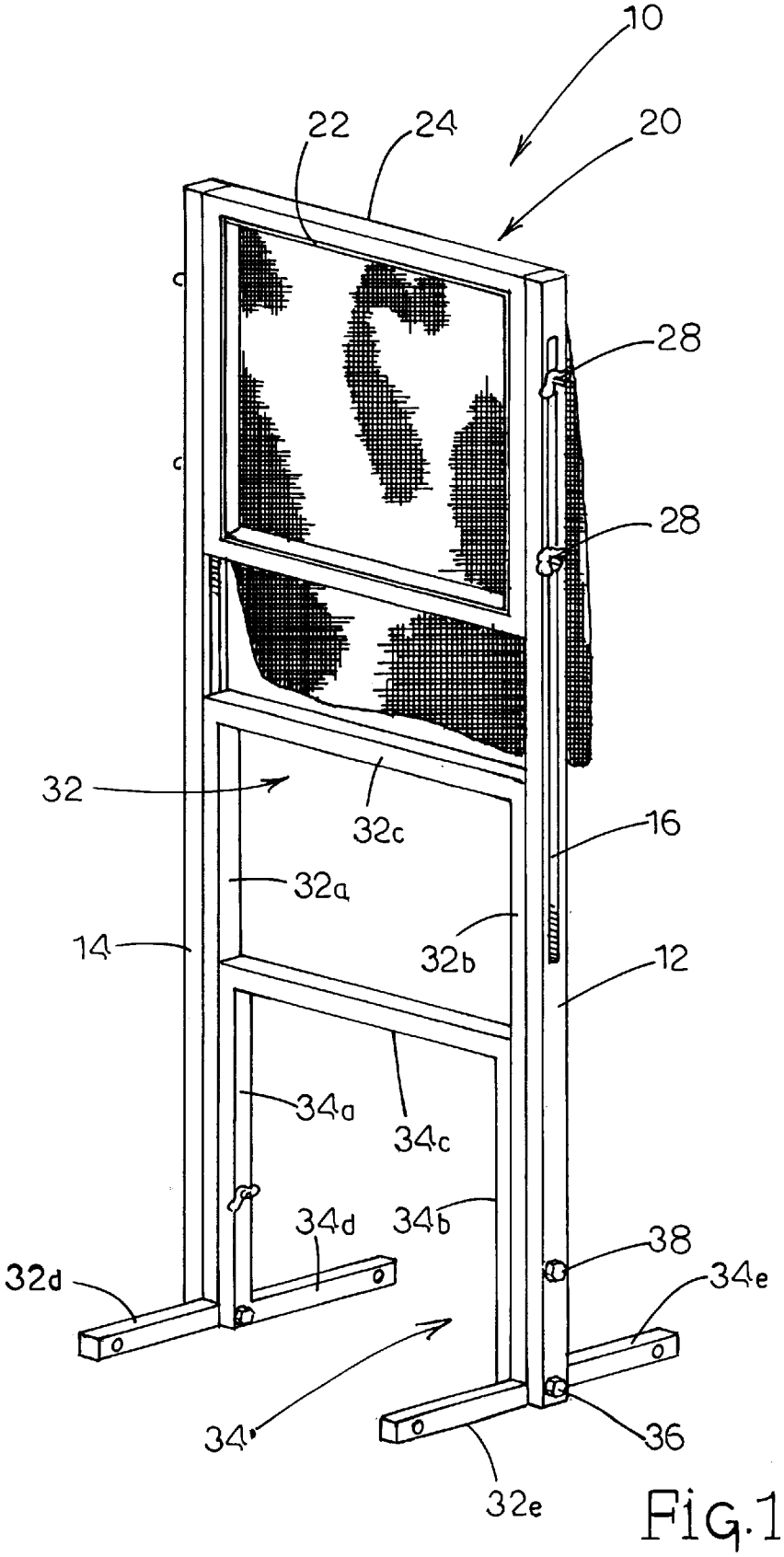
FIG. 1 is a perspective view of the baseball training aid of the present invention shown in the folded and inoperative mode.

With further reference to the drawings, the baseball pitching and throwing practice aid is shown therein and indicated generally by the numeral 10. Viewing the pitching and throwing practice aid 10 in more detail, it is seen that the same includes a basic upright frame structure. This upright frame structure includes a pair of laterally spaced elongated support members 12 and 14. Formed in each of the support members 12 and 14 is an elongated slot 16 that extends transversally through each respective support member 12 and 14.

The frame structure just described is designed to receive and hold a strike zone or a target area and as will be appreciated from reviewing the drawings in this disclosure, the strike zone or target area is movably mounted for vertical adjustment. Viewing this structure in more detail, there is provided a target frame, indicated generally by the numeral 20. The target frame is effectively sandwiched between the upright support members 12 and 14 and movable up and down therein. Although the structure of the target frame 20 can vary, in the embodiment illustrated herein, the target frame includes an inner frame 22 and an outer frame 24. Secured to the target frame 20 is a catching net 30. There are various ways to secure the net 30 to the target frame 20, but in the embodiment illustrated herein, it is contemplated that the net 30 would include an outer terminal edge that would be sandwiched between the inner frame 22 and the outer frame 24 of the target frame 20. It will be appreciated that the inner frame can be secured internally within the outer frame by any appropriate means such as glue, screws, etc.

Projecting outwardly from each side of the target frame 20 is a pair of vertically spaced guides 26. The guides 26 are anchored within the perimeter of the target frame 20 and project outwardly therefrom through the slots 16 formed in the upright support members 12 and 14. In the case of the embodiment illustrated herein, the guides 26 include a series of threaded shafts that project through the slots. Secured to each of the guides is a screw on fastener 28. It will be appreciated that by screwing the respective fasteners 28 down onto the guides 26, that the fasteners will engage the outer sides of the upright members 12 and 14 and will effectively anchor the target frame 20 in any desired position within the frame structure. Simply by loosening the fasteners 28, an individual will be able to raise and lower and particularly station the target frame 20 at any desired height with respect to an underlying support area such as a ground area.

The baseball pitching and throwing practice aid of the present invention is designed to be portable such that it can be easily stored and carried from one location to another. To achieve storage and portability, the practice aid 10 is provided with a fold-out leg structure. The fold-out leg structure, in one mode, will assume a stowed position as illustrated in FIG. 1. In an operative or practice position, the fold-out leg structure will extend outwardly from the upright support members 12 and 14 so as to support the entire practice aid above an underlying support area.

Viewing the fold-out leg structure in more detail, it is seen that the same includes a pair of legs, a first leg indicated generally by the numeral 32 and a second leg indicated generally by the numeral 34. Viewing the first leg 32 in more detail, it is seen that it includes a pair of vertical members 32*a* and 32*b* and an upper cross member 32*c*. Secured at the base of the first leg is a pair of locking fingers 32*d* and 32*e*, with each locking finger including a locking aperture formed therein.

Disposed inwardly of the first leg 32, is the second leg 34, which includes a pair of vertical members 34*a* and 34*b*, interconnected by a transverse or cross member 34*c*. Formed about the base of the second leg 34 is a pair of locking fingers 34*d* and 34*e*, with each locking finger including a locking aperture formed therein.

Figure 2:
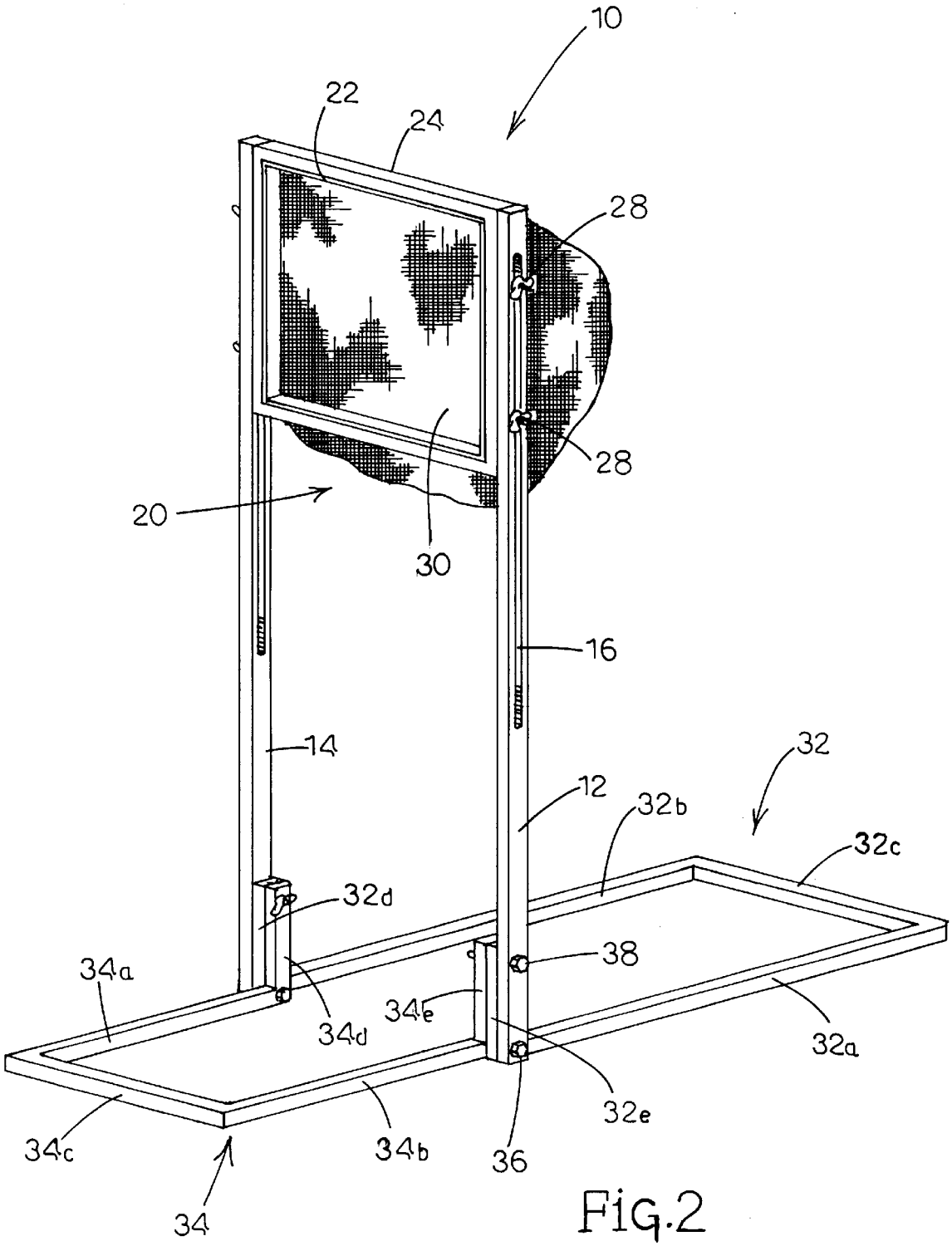
FIG. 2 is a perspective view of the baseball training aid of the present invention shown in the operative or practice mode.

Note that both the first leg 32 and the second leg 34 is pivotally connected to the lower ends of the upright support members 12 and 14 via a pair of pivot pin 36. Disposed of above the pivot pins 36 is a pair of locking pins 38. In the stowed or folded position shown in FIG. 1, it is seen that the locking pins 38 extend through apertures formed in the respective vertical members of the first and second legs. To rotate the legs 32 and 34 outwardly to the position assumed in FIG. 2, the locking pins 38 are removed from the structure and the respective legs are rotated to their operative or outwardly projecting position shown in FIG. 2. Now the locking pins 38 are reinserted through the apertures within the upright support members 12 and 14 and through the locking apertures formed in the locking fingers of the respective legs 32 and 34. Now, as viewed in FIG. 2, the baseball pitching and throwing practice aid 10 is supported in a stable and upright position over an underlying support area such as a ground surface.

Figure 3:
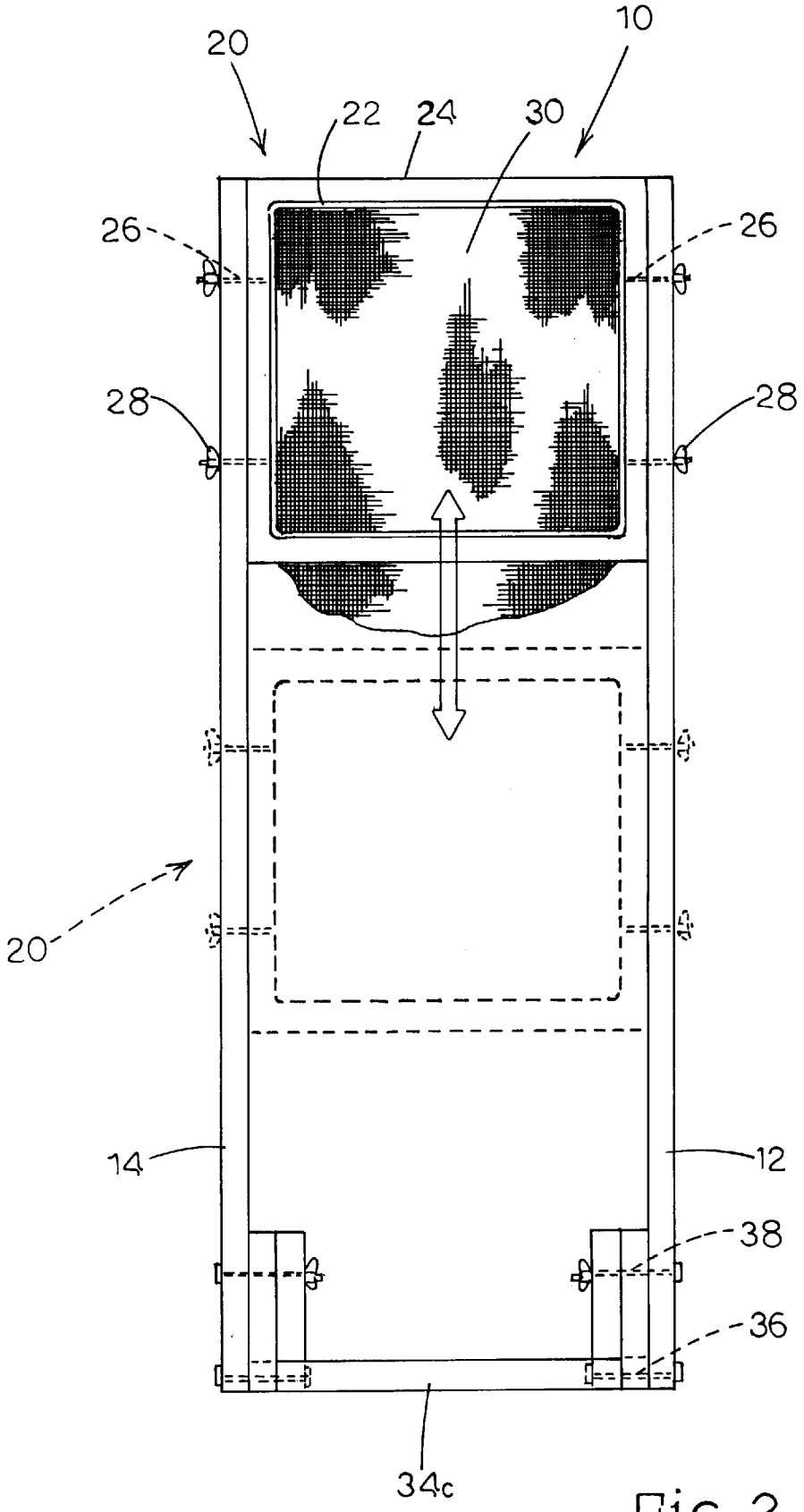
FIG. 3 is a front elevational view of the baseball training aid of the present invention.
Figure 4:
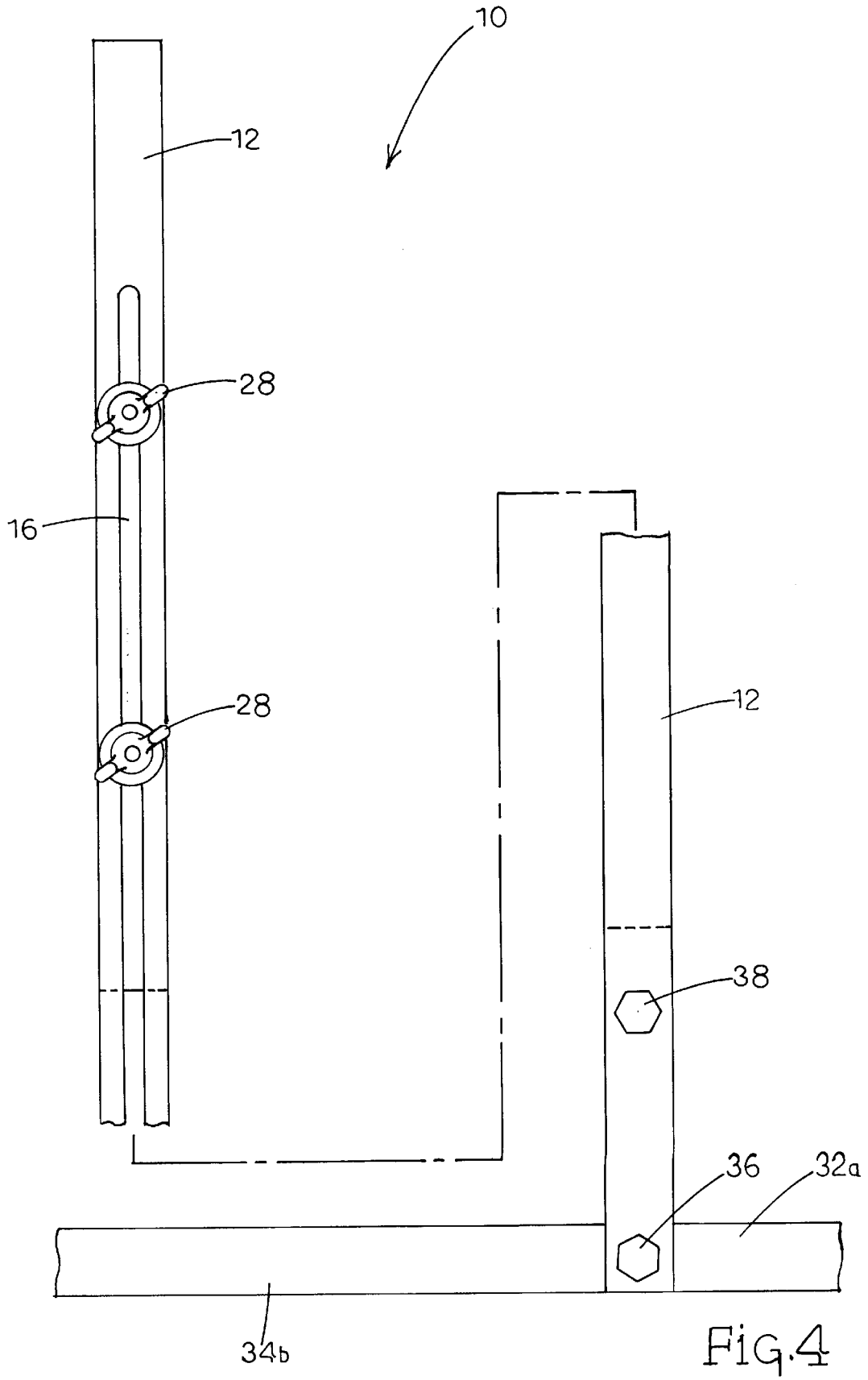
FIG. 4 is a side elevational view illustrating the basic structure of the baseball practice aid of the present invention.

As illustrated in FIG. 3, the target frame 20 can be vertically adjusted and positioned at any desired location within the overall frame structure of the practice aid.

The practice aid 10 of the present invention can be used to practice both conventional pitching and throwing to a target area. Thus, the device is a valuable teaching aid for pitchers as well as other players. For example, infielders such as a third baseman or a shortstop could practice taking grounders and throwing at the target frame 20 with the idea that the practice aid could be stationed at, for example, first base.

The adjustability and dimensions of the target frame 20 can vary. It is contemplated that at least in some embodiments, the target frame 20 would assume the general dimensions of an average strike zone. In this regard, it is contemplated that the inside dimensions of the target frame would be approximately seventeen (17) inches across and sixteen (16) inches high. Again these dimensions can vary. In addition, it is contemplated that the target frame 20 could be adjusted to a height such that its top portion was at a height of approximately five feet and adjusted down to where its lower portion was located at approximately eighteen inches off the ground.

It will be appreciated, that the baseball pitching and throwing practice aid of the present invention can be constructed of various types of material. For example, the basic structure of the practice aid 10 could be made from wood, plastic, metal or other suitable means.

From the foregoing specification, it is appreciated that the present invention relates to a useful practice aid for assisting baseball players, especially young players, in developing their pitching and throwing skills. Because of the adjustability of the practice aid, it follows that the device has a wide application in training and developing all types of pitching and throwing skills.

The present invention may, of course, be carried out in other specific ways than those herein set forth without departing from the spirit and the essential characteristics of the invention. The present embodiments are therefore to be construed in all aspects as illustrative and not restrictive and all changes coming within the meaning and equivalency range of the appended claims are intended to be embraced therein.

What is claimed is:

1. A baseball pitching and throwing training apparatus comprising:

a. a pair of laterally spaced upright support members;

b. an elongated slot formed in each upright support member;

c. a movable target frame secured between the upright support members and movable up and down between the upright support members;

d. a series of guides secured to the target frame and projecting outwardly therefrom through the slots formed in the upright support members;

e. target fasteners that secure to the guides and for abutting against the upright support members for securing the target frame in a selected vertical position between the upright support members;

f. a catch connected to the target frame for catching and holding baseballs;

g. a fold-out support structure attached to said upright support members and movable between an upright stowed position and an outwardly extended position contacting a support surface where the support structure acts to support the upright support members and target frame in an operative position; and h. wherein said fold-out support structure includes first and second legs, and first and second locking pins, each leg being pivotally connected between the upright support members and movable between the stowed position where they align with the upright support members and wherein the locking pins secures the legs to the upright support members and a support position where the respective legs extend outwardly from the support members to engage said support surface so as to support the upright support members and target frame in an operative and practice mode and wherein the locking pins secure the legs in the support position.

2. The baseball pitching and throwing training apparatus of claim 1 wherein the legs of the fold-out structure lie in the same general plane when the legs assume the stowed position.

3. The baseball pitching and throwing apparatus of claim 2 wherein each leg is of an open construction and includes a pair of side members interconnected by a transverse member.

4. The baseball pitching and throwing training apparatus of claim 3 including a locking pin for interlocking the respective legs with the upright support members in both the stowed position and the support position.

5. The baseball pitching and throwing apparatus of claim 4 wherein the target frame includes an inner and an outer frame and wherein the catcher includes an edge that is sandwiched and held between the inner and outer frames of the target frame so as to effectively secure the catcher to the target frame.

6. The baseball pitching and throwing training apparatus of claim 5 wherein the guides include a series of threaded bolts and wherein the target fasteners include nuts that can be screwed onto the threaded bolts for securing the target frame at selected vertical positions.

7. A baseball pitching and throwing training apparatus comprising:

a. an upright support structure;

b. a baseball target movably mounted within the upright support structure;

c. a guide structure for guiding said baseball target up and down within the upright frame structure;

d. at least one fastener for fastening the baseball target in one of a series of selected vertical positions;

e. said support structure including a pair of guide receiving slots formed therein and wherein there is provided a series of horizontal projection guides secured to the baseball target and projecting outwardly therefrom for engagement and confinement with the guide slots and wherein the guides move up and down within the guide slots as the baseball target is vertically adjusted;

f. wherein the upright support structure includes a pair of laterally spaced support posts and wherein the guide slots are formed in the support posts and wherein the guides are confined within the guide slots within the support posts such that the baseball target can be moved up and down between the two support posts;

g. a fold-out support structure attached to said support and movable between an upright position and an outwardly extended position contacting a support surface where the support structure acts to support the support posts and target frame in an operative position; and h. wherein said fold-out support structure includes first and second legs and first and second locking pins, each leg being pivotally connected between the support posts and moveable between a stowed position where they align with the support posts and wherein the locking pin connect the legs to the support posts, and a support position where the respective legs extend outwardly from the support posts to engage said support surface so as to support the support posts and target frame in an operative and practice mode and wherein the locking pins secure the respective legs to the support posts.

8. The baseball pitching and throwing training apparatus of claim 7 including a fold-out support structure that is movably mounted with respect to the upright support structure and movable between a stowed position and an extended operative position and wherein in the extended operative position the fold-out support structure engages an underlying support area and supports the baseball pitching and throwing training apparatus in an upright operative mode.

9. The baseball pitching and throwing training apparatus of claim 8 wherein the fold-out support structure includes a pair of legs with each leg being pivotally connected to the upright support structure and movable between the stowed and operative position.

10. The baseball pitching and throwing training apparatus of claim 9 wherein each leg assumes a generally u shaped configuration and in the stowed mode the two legs generally lie one within the other and in the operative support mode each of the legs swings outwardly towards a respective side of the baseball pitching and throwing training apparatus for engagement with the underlying surface.

11. The baseball pitching and throwing training apparatus of claim 10 including a pair of locking pins for locking the respective legs in both the stowed and operative positions.

12. The baseball pitching and throwing training apparatus of claim 7 wherein the upright support structure includes a pair of upright posts with each post including an elongated slot formed therein.

13. The baseball pitching and throwing training apparatus of claim 7 wherein the guides include a threaded bolt that projects completely through the guide slots formed in the support posts, and wherein there is provided a series of fasteners for screwing onto the threaded guides so as to secure the baseball target in any one of a plurality of vertically adjustable positions.

* * * * *